US008115716B2

(12) United States Patent
Sawahata

(10) Patent No.: US 8,115,716 B2
(45) Date of Patent: Feb. 14, 2012

(54) LIQUID CRYSTAL DISPLAY DEVICE AND ITS DRIVE METHOD

(75) Inventor: Junichi Sawahata, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 1054 days.

(21) Appl. No.: 11/922,758

(22) PCT Filed: Jul. 4, 2006

(86) PCT No.: PCT/JP2006/313314

§ 371 (c)(1),
(2), (4) Date: Dec. 21, 2007

(87) PCT Pub. No.: WO2007/015348

PCT Pub. Date: Feb. 8, 2007

(65) Prior Publication Data

US 2009/0225066 A1 Sep. 10, 2009

(30) Foreign Application Priority Data

Aug. 4, 2005 (JP) ..... 2005-226401

(51) Int. Cl.
*G09G 3/36* (2006.01)

(52) U.S. Cl. ..... 345/90; 345/92; 345/98; 345/211; 345/96; 345/204

(58) Field of Classification Search ..... 345/211, 345/98, 92, 100, 96, 94, 87–89, 208–209, 345/55, 204

See application file for complete search history.

(56) References Cited

U.S. PATENT DOCUMENTS 4,488,150 A 12/1984 Kanatani
6,473,077 B1 10/2002 Takenaka et al.

(Continued)

FOREIGN PATENT DOCUMENTS

EP 1 253 199 8/2002

(Continued)

OTHER PUBLICATIONS

European Search Report dated Sep. 29, 2010 for corresponding European Patent Application of a related U.S. Application.

(Continued)

*Primary Examiner* — Lun-Yi Lao
*Assistant Examiner* — Olga Merkoulova
(74) *Attorney, Agent, or Firm* — Harness, Dickey & Pierce, P.L.C.

(57) ABSTRACT

In the liquid crystal display device adjacent source lines may be short-circuited during horizontal scanning periods. A gate driver sequentially may apply a pixel data write pulse to gate lines in each frame period and may apply a black voltage application pulse during the horizontal scanning periods which is after the lapse of a period of the order of a 2/3 frame from the application of the pixel data write pulse to each gate line. A source driver may connect each source line to a charge sharing voltage fixing power supply during the horizontal scanning periods where the adjacent source lines are short-circuited, and thereby brings a charge sharing voltage to the same value regardless of display gradation.

5 Claims, 9 Drawing Sheets

U.S. PATENT DOCUMENTS

| | | | | |
|---|---|---|---|---|
| 6,642,916 | B1 * | 11/2003 | Kodama et al. | 345/100 |
| 6,937,224 | B1 | 8/2005 | Miyachi | |
| 7,193,601 | B2 * | 3/2007 | Furuya | 345/100 |
| 7,471,275 | B2 * | 12/2008 | Shieh et al. | 345/98 |
| 2002/0118154 | A1 | 8/2002 | Kim | |
| 2003/0058229 | A1 | 3/2003 | Kawabe et al. | |
| 2003/0090449 | A1 | 5/2003 | Arimoto et al. | |
| 2003/0151572 | A1 * | 8/2003 | Kumada et al. | 345/87 |
| 2004/0041763 | A1 | 3/2004 | Kodama et al. | |
| 2004/0104881 | A1 | 6/2004 | Furuya | |
| 2004/0178981 | A1 | 9/2004 | Asada et al. | |
| 2004/0217931 | A1 | 11/2004 | Shin | |
| 2005/0017935 | A1 | 1/2005 | Hirama | |
| 2005/0083278 | A1 | 4/2005 | Teraishi | |
| 2006/0001628 | A1 | 1/2006 | Kawaguchi | |
| 2006/0028463 | A1 | 2/2006 | Nakamura et al. | |
| 2006/0050043 | A1 | 3/2006 | Kawagoe | |
| 2006/0061540 | A1 | 3/2006 | Harada | |
| 2007/0030230 | A1 | 2/2007 | Lee | |
| 2010/0066719 | A1 | 3/2010 | Hirao | |

FOREIGN PATENT DOCUMENTS

| | | | |
|---|---|---|---|
| EP | 1 286 202 | | 2/2003 |
| EP | 1 424 589 | | 6/2004 |
| GB | 2 429 569 | | 2/2007 |
| JP | 02-204718 | | 8/1990 |
| JP | 9-212137 | | 8/1997 |
| JP | 9-243998 | A | 9/1997 |
| JP | 11-30975 | | 2/1999 |
| JP | 11-85115 | | 3/1999 |
| JP | 2000-122596 | | 4/2000 |
| JP | 2000-148098 | | 5/2000 |
| JP | 2000-267141 | | 9/2000 |
| JP | 2001-60078 | | 3/2001 |
| JP | 2001-134245 | | 5/2001 |
| JP | 2002-62855 | | 2/2002 |
| JP | 2002-268613 | | 9/2002 |
| JP | 2002-328654 | | 11/2002 |
| JP | 2003-66918 | | 3/2003 |
| JP | 2003-140624 | A | 5/2003 |
| JP | 2003-255912 | | 10/2003 |
| JP | 2003-302951 | | 10/2003 |
| JP | 2004-061552 | | 2/2004 |
| JP | 2004-279626 | | 10/2004 |
| JP | 2004-334171 | | 11/2004 |
| JP | 2005-12911 | | 5/2005 |
| JP | 2006-047847 | | 2/2006 |
| JP | 2006-72078 | | 3/2006 |
| JP | 2007-41548 | | 2/2007 |

OTHER PUBLICATIONS

Extended European Search Report dated Nov. 5, 2010.

Supplementary European Search Report dated Dec. 23, 2010 for corresponding European Patent Application of a related U.S. Application.

English translation of Chinese Office Action dated Dec. 16, 2010 for corresponding Chinese Patent Application No. 200780022213.2 of a related U.S. Application.

U.S. Office Action dated Mar. 14, 2011 for co-pending U.S. Appl. No. 11/922,756.

Office Action by the Japanese Patent Office dated May 31, 2011 for corresponding Japanese Patent Application JP 61-228491 with machine translation.

U.S. Office Action dated Oct. 20, 2011, for corresponding U.S. Appl. No. 11/922,756.

* cited by examiner

LIQUID CRYSTAL DISPLAY DEVICE AND ITS DRIVE METHOD

TECHNICAL FIELD

The present invention relates to an active matrix type liquid crystal display device using switching elements such as thin film transistors and a drive method for the liquid crystal display device, and more particularly to improvement in moving image display performance of such a liquid crystal display device.

BACKGROUND ART

In an impulse type display device such as a CRT (Cathode Ray Tube), when focusing attention on individual pixels, a light-on period during which an image is displayed and a light-off period during which an image is not displayed are alternately repeated. For example, also in a case where display of a moving image is performed, a light-off period is inserted when rewrite of an image for one screen is performed, and thus an afterimage of a moving object does not occur in human vision. Hence, a background and an object can be clearly distinguished from each other and a moving image is viewed without uncomfortable feeling.

On the other hand, in a hold type display device such as a liquid crystal display device using TFTs (Thin Film Transistors), luminance of an individual pixel is determined by a voltage held in each pixel capacitance, and a voltage held in a pixel capacitance is, once having been rewritten, maintained for one frame period. In this manner, in a hold type display device, a voltage to be held in a pixel capacitance as pixel data is, once having been written, held until the next time the voltage is rewritten; thus an image of each frame temporally approximates an image of its previous frame. Accordingly, when a moving image is displayed, an afterimage of a moving object occurs in human vision. For example, as shown in FIG. 13, an afterimage AI occurs such that an image OI representing a moving object leaves a trail (such an afterimage is hereinafter referred to as a "trailing afterimage").

In a hold type display device such as an active matrix type liquid crystal display device, such a trailing afterimage occurs when a moving image is displayed, and thus, conventionally it is common to adopt an impulse type display device for a display of a television set, etc., on which moving image display is mainly performed. However, in recent years, there has been a strong demand for reduction in weight and slimming down of a display of a television set, etc., and thus adoption of a hold type display device, such as a liquid crystal display device, that facilitates reduction in weight and slimming down of such a display has rapidly progressed.

Patent Document 1: Japanese Unexamined Patent Publication No. 9-243998

Patent Document 2: Japanese Unexamined Patent Publication No. 11-85115

Patent Document 3: Japanese Unexamined Patent Publication No. 2003-66918

Patent Document 4: Japanese Unexamined Patent Publication No. 2004-279626

Patent Document 5: Japanese Unexamined Patent Publication No. 2005-121911

DISCLOSURE OF THE INVENTION

Problems to be Solved by the Invention

As a method for improving the above-described trailing afterimage in a hold type display device such as an active matrix type liquid crystal display device, a method is known in which display in a liquid crystal display device is made impulse display (artificially) by, for example, inserting in one frame period a period during which black display is performed (hereinafter, referred to as "black insertion") (e.g. Japanese Unexamined Patent Publication No. 2003-66918 (Patent Document 3)).

However, when impulse is implemented by the conventional method in an active matrix type liquid crystal display device which is a hold type display device, due to black insertion, a drive circuit and the like become complex and the operation frequency of the drive circuit also increases and thus the length of time that can be reserved for charging pixel capacitances is also reduced.

In view of this, it is an object of the present invention to provide an active matrix type liquid crystal display device capable of implementing impulse display (in a pseudo manner) while suppressing an increase in complexity of a drive circuit and the like and an increase in operation frequency, and a drive method for the liquid crystal display device.

Means for Solving the Problems

According to a first aspect of the present invention, there is provided an active matrix type liquid crystal display device including:

a plurality of data signal lines;

a plurality of scanning signal lines intersecting the plurality of data signal lines;

a plurality of pixel forming sections arranged in a matrix form correspondingly to respective intersections of the plurality of data signal lines and the plurality of scanning signal lines, each pixel forming section capturing, as a pixel value, a voltage of a data signal line passing through a corresponding intersection when a scanning signal line passing through the corresponding intersection is selected;

a data signal line drive circuit for applying a plurality of data signals representing an image to be displayed, to the plurality of data signal lines, respectively, and for generating the plurality of data signals such that data signals to be respectively applied to adjacent data signal lines have different polarities and polarity of the plurality of data signals is inverted every predetermined cycle in each frame period;

a switching circuit, provided inside or external to the data signal line drive circuit, for cutting off the application of the plurality of data signals to the plurality of data signal lines and short-circuiting the plurality of data signal lines to each other, when the polarity of the plurality of data signal is inverted;

a voltage supplying section for providing a fixed voltage corresponding to black display to the plurality of data signal lines during a predetermined black signal insertion period when the plurality of data signal lines are short-circuited to each other by the switching circuit; and a scanning signal line drive circuit for selectively driving the plurality of scanning signal lines such that each of the plurality of scanning signal lines goes to a selected state at least once during an effective scanning period in each frame period and a scanning signal line brought to a selected state during the effective scanning period goes to a selected state at least once during the black signal insertion period within a period from when a predetermined pixel value holding period has elapsed since the scanning signal line is changed from the selected state to a non-selected state until the scanning signal line goes to a selected state during an effective scanning period in a next frame period, the effective scanning period being a period other than the black signal insertion period.

According to a second aspect of the present invention, in the first aspect of the present invention, the data signal line drive circuit includes output buffers for outputting data signals to be applied to the respective data signal lines, and the switching circuit includes:

a first switching element provided between each data signal line and a corresponding one of the output buffers and going to a cut-off state during the black signal insertion period;

a second switching element provided between adjacent data signal lines and going to a conducting state during the black signal insertion period; and a third switching element provided between any one of the plurality of data signal lines and the voltage supplying section and going to a conducting state during the black signal insertion period.

According to a third aspect of the present invention, in the first aspect of the present invention, the data signal line drive circuit includes output buffers for outputting data signals to be applied to the respective data signal lines, and the switching circuit includes:

a first switching element provided between each data signal line and a corresponding one of the output buffers and going to a cut-off state during the black signal insertion period; and a second switching element provided between each data signal line and the voltage supplying section and going to a conducting state during the black signal insertion period.

According to a fourth aspect of the present invention, in the first aspect of the present invention, the scanning signal line drive circuit causes a scanning signal line brought to a selected state during the effective scanning period to go to a selected state a plurality of times during the black signal insertion periods within a period from when the pixel value holding period has elapsed since the scanning signal line is changed from the selected state to a non-selected state until the scanning signal line goes to a selected state during an effective scanning period in a next frame period.

According to a fifth aspect of the present invention, there is provided a drive method for an active matrix type liquid crystal display device including a plurality of data signal lines; a plurality of scanning signal lines intersecting the plurality of data signal lines; and a plurality of pixel forming sections arranged in a matrix form correspondingly to respective intersections of the plurality of data signal lines and the plurality of scanning signal lines, each pixel forming section capturing, as a pixel value, a voltage of a data signal line passing through a corresponding intersection when a scanning signal line passing through the corresponding intersection is selected, the drive method including:

a data signal line driving step of applying a plurality of data signals representing an image to be displayed, to the plurality of data signal lines, respectively, and generating the plurality of data signals such that data signals to be respectively applied to adjacent data signal lines have different polarities and polarity of the plurality of data signals is inverted every predetermined cycle in each frame period;

a connection switching step of cutting off the application of the plurality of data signals to the plurality of data signal lines and short-circuiting the plurality of data signal lines to each other, when the polarity of the plurality of data signal is inverted;

a voltage supplying step of providing a fixed voltage corresponding to black display to the plurality of data signal lines during a predetermined black signal insertion period when the plurality of data signal lines are short-circuited to each other; and a scanning signal line driving step of selectively driving the plurality of scanning signal lines such that each of the plurality of scanning signal lines goes to a selected state at least once during an effective scanning period in each frame period and a scanning signal line brought to a selected state during the effective scanning period goes to a selected state at least once during the black signal insertion period within a period from when a predetermined pixel value holding period has elapsed since the scanning signal line is changed from the selected state to a non-selected state until the scanning signal line goes to a selected state during an effective scanning period in a next frame period, the effective scanning period being a period other than the black signal insertion period.

EFFECTS OF THE INVENTION

According to the first or fifth aspect of the present invention, during a black signal insertion period which is when the polarity of data signals is inverted, the voltage of each data signal line has a value corresponding to black display and each scanning signal line goes to a selected state at least once during the black signal insertion period after the lapse of a predetermined pixel value holding period from when the scanning signal line is selected during an effective scanning period to write a pixel value. Accordingly, a black display period exists until the next time the scanning signal line goes to a selected state during an effective scanning period to write a pixel value, and thus, black insertion of the same length is performed on all display lines and without reducing the charging period for a pixel capacitance for writing a pixel value, by implementing impulse by reserving a sufficient black insertion period, the display quality of a moving image can be improved. In addition, the operating speed of a data signal line drive circuit and the like does not need to be increased for black insertion. In addition, since a fixed voltage corresponding to black display is provided to each data signal line during the black signal insertion period, even when the amount of correction of a data signal is different depending on the display gradation due to compensating for gradation dependence of a pull-in voltage based on a parasitic capacitance in each pixel forming section, the voltage of each data signal line for the black signal insertion period is always the same voltage. Accordingly, degradation of display quality caused by occurrence of a shadow of a pattern due to black insertion, or the like, can be prevented.

According to the second aspect of the present invention, during the black signal insertion period, by the first switching elements going to a cut-off state each data signal line is electrically disconnected from a corresponding output buffer in the data signal line drive circuit, by the second switching elements going to a conducting state adjacent data signal lines are short-circuited to each other, and by the third switching element going to a conducting state a fixed voltage corresponding to black display is provided to each data signal line. Accordingly, even when the amount of correction of a data signal is different depending on the display gradation due to compensating for gradation dependence of a pull-in voltage based on a parasitic capacitance in each pixel forming section, the voltage of each data signal line for the black signal insertion period is always the same voltage and thus degradation of display quality caused by occurrence of a shadow of a pattern due to black insertion, or the like, can be prevented.

According to the third aspect of the present invention, during the black signal insertion period, by the first switching elements going to a cut-off state each data signal line is electrically disconnected from a corresponding output buffer in the data signal line drive circuit, and by the second switching elements going to a conducting state a fixed voltage corresponding to black display is provided to each data signal line. Accordingly, even when the amount of correction of a data signal is different depending on the display gradation due to compensating for gradation dependence of a pull-in voltage based on a parasitic capacitance in each pixel forming section, the voltage of each data signal line for the black signal insertion period is always the same voltage. Moreover, during the black signal insertion period, the above-described fixed voltage is provided to each data signal line through only one switching element, and thus, the voltages of respective data signal lines can be brought to the same voltage which corresponds to black display in a short time. Accordingly, degradation of display quality caused by occurrence of a shadow of a pattern due to black insertion, or the like, can be surely prevented.

According to the fourth aspect of the present invention, a scanning signal line brought to a selected state during an effective scanning period is brought to a selected state a plurality of times during black signal insertion periods within a period from when a predetermined pixel value holding period has elapsed since the scanning signal line is changed from the selected state to a non-selected state until the scanning signal line goes to a selected state during an effective scanning period in a next frame period. Accordingly, display luminance can be set to a sufficient black level during a black display period for implementing impulse.

DESCRIPTION OF THE SYMBOLS

10: TFT (SWITCHING ELEMENT)
31: OUTPUT BUFFER
33: INVERTER
40: SHIFT REGISTER
41 and 43: AND GATE
45: OUTPUT SECTION
47: SELECTOR SWITCH
100: DISPLAY SECTION
200: DISPLAY CONTROL CIRCUIT
300: SOURCE DRIVER (DATA SIGNAL LINE DRIVE CIRCUIT)
302: DATA SIGNAL GENERATING SECTION
304: OUTPUT SECTION
400: GATE DRIVER (SCANNING SIGNAL LINE DRIVE CIRCUIT)
411, 412, . . . , 41*q*: GATE DRIVER IC CHIP
Cp: PIXEL CAPACITANCE
Ec: COMMON ELECTRODE
SWa: FIRST MOS TRANSISTOR (FIRST SWITCHING ELEMENT)
SWb: SECOND MOS TRANSISTOR (SECOND SWITCHING ELEMENT)
SWb2: THIRD MOS TRANSISTOR (THIRD SWITCHING ELEMENT)
SWc: SECOND MOS TRANSISTOR (SECOND SWITCHING ELEMENT)
SLi: SOURCE LINE (DATA SIGNAL LINE) (i=1, 2, . . . , n)
GLj: GATE LINE (SCANNING SIGNAL LINE) (j=1, 2, . . . , m)
DA: DIGITAL IMAGE SIGNAL
SSP: DATA START PULSE SIGNAL
SCK: DATA CLOCK SIGNAL
GSP: GATE START PULSE SIGNAL
GCK: GATE CLOCK SIGNAL
Csh: CHARGE SHARING CONTROL SIGNAL.
GOE: GATE DRIVER OUTPUT CONTROL SIGNAL
GOEr: GATE DRIVER OUTPUT CONTROL SIGNAL (r=1, 2, q)
S(i): DATA SIGNAL (i=1, 2, . . . , n)
G(j): SCANNING SIGNAL (j=1, 2, . . . , m)
Pw: PIXEL DATA WRITE PULSE
Pb: BLACK VOLTAGE APPLICATION PULSE
Thd: PIXEL DATA HOLDING PERIOD (PIXEL VALUE HOLDING PERIOD)
Tbk: BLACK DISPLAY PERIOD
Tsh: CHARGE SHARING PERIOD (BLACK SIGNAL INSERTION PERIOD)

BEST MODE FOR CARRYING OUT THE INVENTION

An embodiment of the present invention will be described below with reference to the accompanying drawings.

1. Basic Configuration and Operation Thereof

First, a liquid crystal display device of a configuration that is the base of the embodiment of the present invention (hereinafter, referred to as the "liquid crystal display device according to the basic configuration") will be described.

Figure 1:
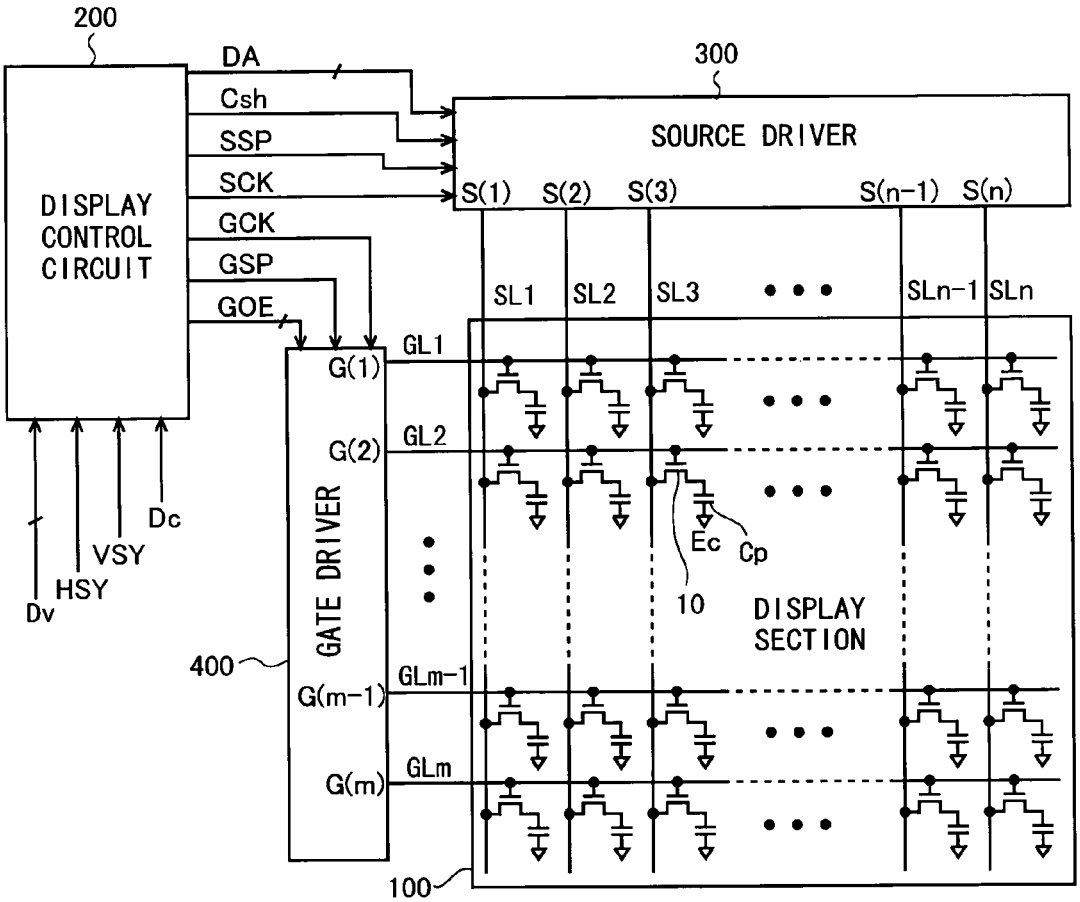
FIG. 1 is a block diagram showing a configuration of a liquid crystal display device according to an embodiment of the present invention and a configuration (basic configuration) that is the base thereof, together with an equivalent circuit of a display section of the liquid crystal display device.

FIG. 1 is a block diagram showing a configuration of the above-described liquid crystal display device, together with an equivalent circuit of a display section of the liquid crystal display device. The liquid crystal display device includes a source driver 300 serving as a data signal line drive circuit, a gate driver 400 serving as a scanning signal line drive circuit, an active matrix type display section 100, and a display control circuit 200 for controlling the source driver 300 and the gate driver 400.

The display section 100 in the above-described liquid crystal display device includes a plurality of (m) gate lines GL1 to GLm serving as scanning signal lines; a plurality of (n) source lines SL1 to SLn serving as data signal lines and intersecting the gate lines GL1 to GLm, respectively; and a plurality of (m×n) pixel forming sections provided correspondingly to respective intersections of the gate lines GL1 to GLm and the source lines SL1 to SLn. The pixel forming sections are arranged in a matrix form to configure a pixel array, and each pixel forming section includes a TFT 10 which is a switching element having a gate terminal connected to a gate line GLj passing through a corresponding intersection and having a source terminal connected to a source line SLi passing through the intersection; a pixel electrode connected to a drain terminal of the TFT 10; a common electrode Ec which is a counter electrode provided to be shared by the plurality of pixel forming sections; and a liquid crystal layer provided to be shared by the plurality of pixel forming sections and sandwiched between the pixel electrode and the common electrode Ec. By a liquid crystal capacitance formed by the pixel electrode and the common electrode Ec, a pixel capacitance Cp is composed. Note that although normally in order to surely hold a voltage in a pixel capacitance an auxiliary capacitance is provided in parallel with a liquid crystal capacitance, the auxiliary capacitance is not directly related to the present invention and thus the description and graphic representation thereof are not given.

To a pixel electrode in each pixel forming section a potential according to an image to be displayed is provided by the source driver 300 and the gate driver 400 which operate in a manner described later, and to the common electrode Ec a predetermined potential Vcom is provided by a power supply circuit which is not shown. Accordingly, a voltage according to a potential difference between the pixel electrode and the common electrode Ec is applied to a liquid crystal and by the voltage application the amount of light transmission through the liquid crystal layer is controlled, whereby image display is performed. Note that to control the amount of light transmission by voltage application to the liquid crystal layer a polarizing plate is used and it is assumed that in the liquid crystal display device according to the basic configuration a polarizing plate is arranged so as to obtain normally black mode.

The display control circuit 200 receives from an external signal source a digital video signal Dv representing an image to be displayed, a horizontal synchronizing signal HSY and a vertical synchronizing signal VSY for the digital video signal Dv, and a control signal Dc for controlling a display operation, and generates and outputs, based on the signals Dv, HSY, VSY, and Dc, a data start pulse signal SSP, a data clock signal SCK, a charge sharing control signal Csh, a digital image signal DA (a signal corresponding to the video signal Dv) representing an image to be displayed, a gate start pulse signal GSP, a gate clock signal GCK, and a gate driver output control signal GOE, as signals for displaying the image represented by the digital video signal Dv on the display section 100. More specifically, after timing adjustment and the like are performed on a video signal Dv in an internal memory where necessary, the video signal Dv is outputted as a digital image signal DA from the display control circuit 200. Then, a data clock signal SCK is generated as a signal composed of pulses for respective pixels of an image represented by the digital image signal DA. A data start pulse signal SSP is generated, based on a horizontal synchronizing signal HSY, as a signal that is at a high level (H level) during a predetermined period every horizontal scanning period and a gate start pulse signal GSP is generated, based on a vertical synchronizing signal VSY, as a signal that is at an H level during a predetermined period every frame period (vertical scanning period). A gate clock signal GCK is generated based on the horizontal synchronizing signal HSY and a charge sharing control signal Csh and a gate driver output control signal GOE (GOE1 to GOEq) are generated based on the horizontal synchronizing signal HSY and a control signal Dc.

Of the signals generated in the display control circuit 200 in the above-described manner, the digital image signal DA, the charge sharing control signal Csh, and the data start pulse signal SSP and data clock signal SCK are inputted to the source driver 300 and the gate start pulse signal GSP and gate clock signal GCK and the gate driver output control signal GOE are inputted to the gate driver 400.

The source driver 300 sequentially generates, based on the digital image signal DA and the data start pulse signal SSP and data clock signal SCK, data signals S(1) to S(n) every horizontal scanning period, as analog voltages corresponding to pixel values for respective horizontal scanning lines of an image represented by the digital image signal DA and the data signals S(1) to S(n) are applied to the source lines SL1 to SLn, respectively. The source driver 300 of the basic configuration adopts a drive scheme in which the data signals S(1) to S(n) are outputted such that the polarity of a voltage applied to the liquid crystal layer is inverted every frame period and is also inverted every gate line and every source line in each frame, i.e., a dot-inversion drive scheme. Therefore, the source driver 300 inverts the polarity of a voltage applied to the source lines SL1 to SLn every source line and inverts the polarity of a voltage of a data signal S(i) applied to each source line SLi every horizontal scanning period. Here, the potential that serves as a reference for polarity inversion of a voltage applied to the source lines has a direct current level (potential corresponding to a direct current component) of the data signals S(1) to S(n) and the direct current level does not generally match a direct current level of the common electrode Ec and is different from the direct current level of the common electrode Ec by a pull-in voltage ΔVd caused by a parasitic capacitance Cgd between a gate and a drain of a TFT in each pixel forming section. Note, however, that when the pull-in voltage ΔVd caused by the parasitic capacitance Cgd is sufficiently small relative to an optical threshold voltage Vth of a liquid crystal the direct current level of the data signals S(1) to S(n) can be considered to be equal to the direct current level (counter voltage) of the common electrode Ec, and thus, it may be considered that the polarity of the data signals S(1) to S(n), i.e., the polarity of a voltage applied to the source lines, is inverted every horizontal scanning period with the potential of the common electrode Ec as a reference.

Figure 2:
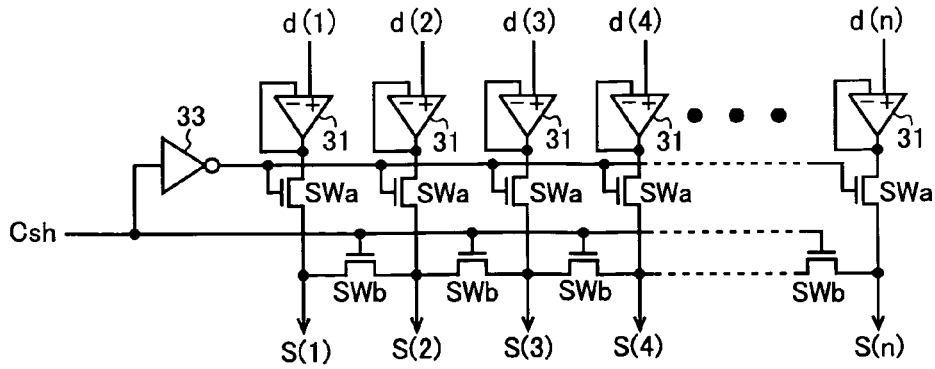
FIG. 2 is a circuit diagram showing a configuration of an output section of a source driver of the basic configuration.

The source driver 300 also adopts a charge sharing scheme in which in order to reduce power consumption adjacent source lines are short-circuited when the polarity of the data signals S(1) to S(n) is inverted. Therefore, an output section which is a portion of the source driver 300 that outputs the data signals S(1) to S(n) is configured as shown in FIG. 2. Specifically, the output section receives analog voltage signals d(1) to d(n) generated based on a digital image signal DA and performs an impedance conversion on the analog voltage signals d(1) to d(n) and thereby generates data signals S(1) to S(n) as video signals to be transmitted by the source lines SL1 to SLn, and has n buffers 31 as voltage followers for the impedance conversion. To an output terminal of each buffer 31 is connected a first MOS transistor SWa serving as a switching element, and a data signal S(i) from each buffer 31 is outputted from an output terminal of the source driver 300 through a first MOS transistor SWa (i=1, 2 . . . , n). Adjacent output terminals of the source driver 300 are connected by a second MOS transistor SWb serving as a switching element (Accordingly, the adjacent source lines are connected by the second MOS transistor SWb). To a gate terminal of the second MOS transistor SWb between the output terminals is provided a charge sharing control signal Csh, and to a gate terminal of the first MOS transistor SWa connected to the output terminal of each buffer 31 is provided an output signal from an inverter 33, i.e., a logically inverted signal of the charge sharing control signal Csh.

Hence, when the charge sharing control signal Csh is non-active (at a low level), the first MOS transistors SWa are turned on (becoming conductive) and the second MOS transistors SWb are turned off (becoming interrupted) and thus a data signal from each buffer 31 is outputted from the source driver 300 through a corresponding first MOS transistor SWa. On the other hand, when the charge sharing control signal Csh is active (at a high level), the first MOS transistors SWa are turned off (becoming interrupted) and the second MOS transistors SWb are turned on (becoming conductive) and thus a data signal from each buffer 31 is not outputted (i.e., application of the data signals S(1) to S(n) to the source lines SL1 to SLn are interrupted) and adjacent source lines in the display section 100 are short-circuited through the second MOS transistors. SWb.

In the source driver 300 of the basic configuration, as shown in FIG. 3(A), an analog voltage signal d(i) is generated as a video signal whose polarity is inverted every horizontal scanning period (1H) and in the display control circuit 200, as shown in FIG. 3(B), a charge sharing control signal Csh is generated which is at a high level (H level) during a predetermined period (a short period of the order of one horizontal blanking period) Tsh when the polarity of each analog voltage signal d(i) is inverted (a period during which the charge sharing control signal Csh is at an H level is hereinafter referred to as a "charge sharing period"). As described above, when the charge sharing control signal Csh is at a low level (L level), each analog voltage signal d(i) is outputted as a data signal S(i) and when the charge sharing control signal Csh is at an H level, application of the data signals S(1) to S(n) to the source lines SL1 to SLn is interrupted adjacent source lines are short-circuited to each other. Since in the basic configuration the dot-inversion drive is adopted, the voltages of adjacent source lines have opposite polarities to each other and moreover the absolute values of the voltages are substantially equal to each other. Therefore, the value of each data signal S(i), i.e., the voltage of each source line SLi, is a voltage corresponding to black display (which may also be simply referred to as a "black voltage") during the charge sharing period Tsh. In the liquid crystal display device, the polarity of each data signal S(i) is inverted with a direct current level VSdc of the data signal S(i) as a reference and thus, as shown in FIG. 3(C), during the charge-sharing period. Tsh, the level of each data signal S(i) is substantially equal to the direct current level VSdc of the data signal S(i). Note that the configuration in which adjacent source lines are thus short-circuited when the polarity of data signals is inverted, whereby the voltage of each source line is made equal to a black voltage (the direct current level VSdc of the data signals S(i)) has been conventionally proposed as a means of reducing power consumption (see Japanese Unexamined Patent Publication No. 9-212137 (Patent Document 1), Japanese Unexamined Patent Publication No. 9-243998 (Patent Document 1), and Japanese Unexamined Patent Publication No. 11-85115 (Patent Document 2) for example) and thus the configuration is not limited to the one shown in FIG. 2.

The gate driver 400 sequentially selects, based on the gate start pulse signal GSP and gate clock signal GCK and a gate driver output control signal GOEr (r=1, 2, . . . , q) the gate lines GL1 to GLm substantially every horizontal scanning period in each frame period (each vertical scanning period) of the digital image signal DA, so as to write data signals S(1) to S(n) into (the pixel capacitances of) their corresponding pixel forming sections, and selects a gate line GLj (j=1 to m) during a predetermined period when the polarity of data signals S(i) is inverted, so as to perform black insertion which will be described later. Specifically, the gate driver 400 applies scanning signals G(1) to G(m) each including a pixel data write pulse Pw and black voltage application pulses Pb, such as those shown in FIGS. 3(D) and 3(E), to the gate lines GL1 to GLm, respectively, and a gate line GLj to which the pulses Pw and Pb are applied goes to a selected state and a TFT 10 connected to the gate line GLj being in the selected state goes to an on state (a TFT 10 connected to a gate line in a non-selected state goes to an off state). Here, the pixel data write pulse Pw is at an H level during an effective scanning period of a horizontal scanning period (1H) corresponding to a display period, whereas the black voltage application pulse Pb is at an H level during a charge sharing period Tsh of a horizontal scanning period (1H) corresponding to a blanking period. In the basic configuration, as shown in FIGS. 3(D) and 3(E), in each scanning signal G(j), the time interval between a pixel data write pulse Pw and a black voltage application pulse Pb which is the first one to appear after the pixel data write pulse Pw is a 2/3 frame period and three black voltage application pulses Pb successively appear in one frame period (1V) at intervals of one horizontal scanning period (1H).

Next, with reference to FIG. 3, the drive of the display section 100 (see FIG. 1) by the above-described source driver 300 and gate driver 400 will be described. In each pixel forming section in the display section 100, by a pixel data write pulse Pw being applied to a gate line GLj connected to a gate terminal of a TFT 10 included in the pixel forming section, the TFT 10 is turned on and a voltage of a source line SLi connected to a source terminal of the TFT 10 is written into the pixel forming section as a value of a data signal S(i). That is, the voltage of the source line SLi is held in a pixel capacitance Cp. Thereafter, the gate line GLj goes to a non-selected state during a period Thd which is before a black voltage application pulse Pb appears, and thus, the voltage written into the pixel forming section is held as it is.

A black voltage application pulse Pb is applied to the gate line GLj during a charge sharing period Tsh which is after the period of the non-selected state (hereinafter, referred to as a "pixel data holding period") Thd. As described above, during the charge sharing period Tsh, a value of each data signal S(i), i.e., a voltage of each source line SLi, is substantially equal to a direct current level of the data signal S(i) (i.e., a black voltage). Thus, by the application of the black voltage application pulse Pb to the gate line GLj, the voltage held in the pixel capacitance Cp of the pixel forming section changes toward a black voltage. However, since the pulse width of the black voltage application pulse Pb is short, in order to surely make the voltage held in the pixel capacitance Cp a black voltage, as shown in FIGS. 3(D) and 3(E), three black voltage application pulses Pb are successively applied to the gate line GLj in each frame period at intervals of one horizontal scanning period (1H). Accordingly, luminance (the amount of transmitted light to be determined by a voltage held in a pixel capacitance) L (j, i) of a pixel formed by the pixel forming section connected to the gate line GLj changes in the manner shown in FIG. 3(F).

Accordingly, in one display line corresponding to pixel forming sections connected to each gate line GLj, during a pixel data holding period Thd, display based on a digital image signal DA is performed and during a period Tbk from when the above-described three black voltage application pulses Pb have been applied after the display until the next time a pixel data write pulse Pw is applied to the gate line GLj, black display is performed. By the period during which black display is performed (hereinafter, referred to as a "black display period") Tbk being thus inserted in each frame period, implementation of impulse display by the liquid crystal display device is performed.

As can also be seen from FIGS. 3(D) and 3(E), since the point in time when a pixel data write pulse Pw appears is shifted by one horizontal scanning period (1H) on each scanning signal G(j), the point in time when a black voltage application pulse Pb appears is also shifted by one horizontal scanning period (1H) on each scanning signal G(j). Accordingly, black insertion of the same length is performed on all display lines such that a black display period Tbk is also shifted by one horizontal scanning period (1H) on each display line. In this manner, without reducing the charging period for a pixel capacitance Cp for writing pixel data, a sufficient black insertion period is reserved. In addition, the operating speed of the source driver 300 and the like does not need to be increased for black insertion.

2. Problem with Basic Configuration

Figure 4:
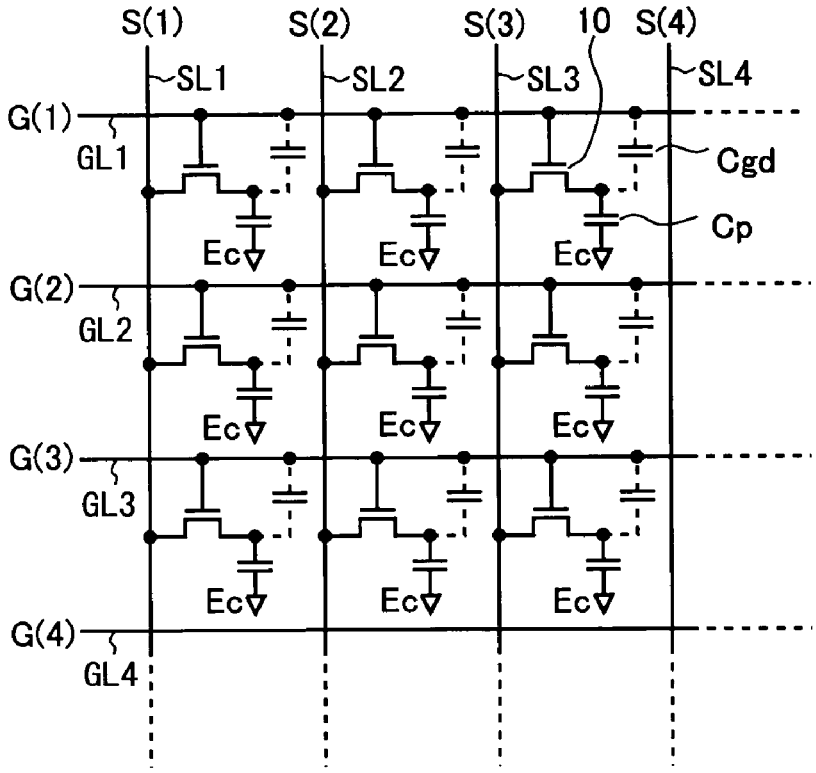
FIG. 4 is a circuit diagram for describing a parasitic capacitance between a gate and a drain of a thin film transistor (TFT) in a pixel forming section of a liquid crystal panel.
Figure 5:
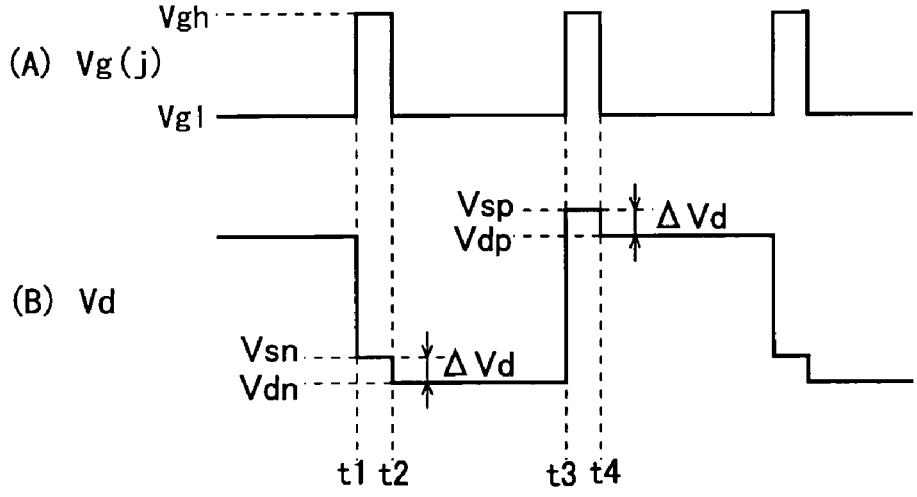
FIGS. 5(A) and 5(B) are voltage waveform diagrams for describing a pull-in voltage resulting from the parasitic capacitance between the gate and drain of the TFT in the pixel forming section of the liquid crystal panel.

Generally, in an active matrix type liquid crystal display device using TFTs, as shown in FIG. 4, a parasitic capacitance Cgd is present between the gate and drain of a TFT 10 in each pixel forming section. Due to the presence of the parasitic capacitance Cgd, a voltage (hereinafter, referred to as a "pixel voltage") Vd of a pixel electrode in each pixel forming section decreases according to the ratio of a parasitic capacitance Cgd to a pixel capacitance Cp when a TFT 10 connected to the pixel electrode is switched to an off state (cut-off state) from an on state (conducting state) (such a pixel voltage change caused by a parasitic capacitance Cgd is hereinafter referred to as a "level shift" and the amount of change is hereinafter referred to as a "pull-in voltage" and represented by the symbol "ΔVd"). Specifically, as shown in FIGS. 5(A) and 5(B), when, after a gate voltage Vg(j) which is a voltage of a scanning signal G(j) to be applied to any one gate line GLj goes to an on voltage Vgh (at time t1 or t3), whereby a voltage Vsn or Vsp of a source line SLi is provided to a pixel electrode through a TFT 10 connected to the gate line GLj, the gate voltage Vg(j) changes to an off voltage Vgl (time t2 or t4), a pixel voltage Vd decreases by an amount of a pull-in voltage ΔVd represented by the following equation (j=1, 2, . . . , m; i=1, 2, . . . , n):

$$\Delta Vd=(Vgh-Vgl)\cdot Cgd/(Cp+Cgd) \quad (1).$$

Since the permittivity of a liquid crystal changes with a voltage to be applied to the liquid crystal, the pixel capacitance Cp has different values for different pixel gradations. Therefore, the above-described pull-in voltage ΔVd is also different depending on the pixel gradation.

Generally, in a liquid crystal display device, the polarity of a voltage applied to a liquid crystal is inverted in a predetermined cycle with the potential of a common electrode Ec, i.e., a counter voltage, being a reference and the light transmittance of the liquid crystal changes according to the effective value of a voltage applied to the liquid crystal. Hence, to obtain display without flicker, the voltage (source voltage) of a source line, i.e., the value of a data signal, needs to be corrected by an amount of the above-described pull-in voltage ΔVd with respect to the counter voltage such that the average value of a voltage applied to the liquid crystal is "0". The pull-in voltage ΔVd is, as described above, different depending on the pixel gradation. In view of this, in order to obtain display without flicker for all gradations, a source voltage is corrected according to the gradation of a pixel to be displayed. That is, the amount of correction of a source voltage is different depending on the display gradation.

Meanwhile, a source voltage (hereinafter, referred to as a "charge sharing voltage") for a charge sharing period Tsh is substantially equal to an average value of a voltage of all source lines of each source driver which is immediately before the charge sharing period. As described above, since the amount of correction of a source voltage is different depending on the pixel gradation, as shown in FIG. 6, a charge sharing voltage is different depending on the display gradation.

Figure 6:
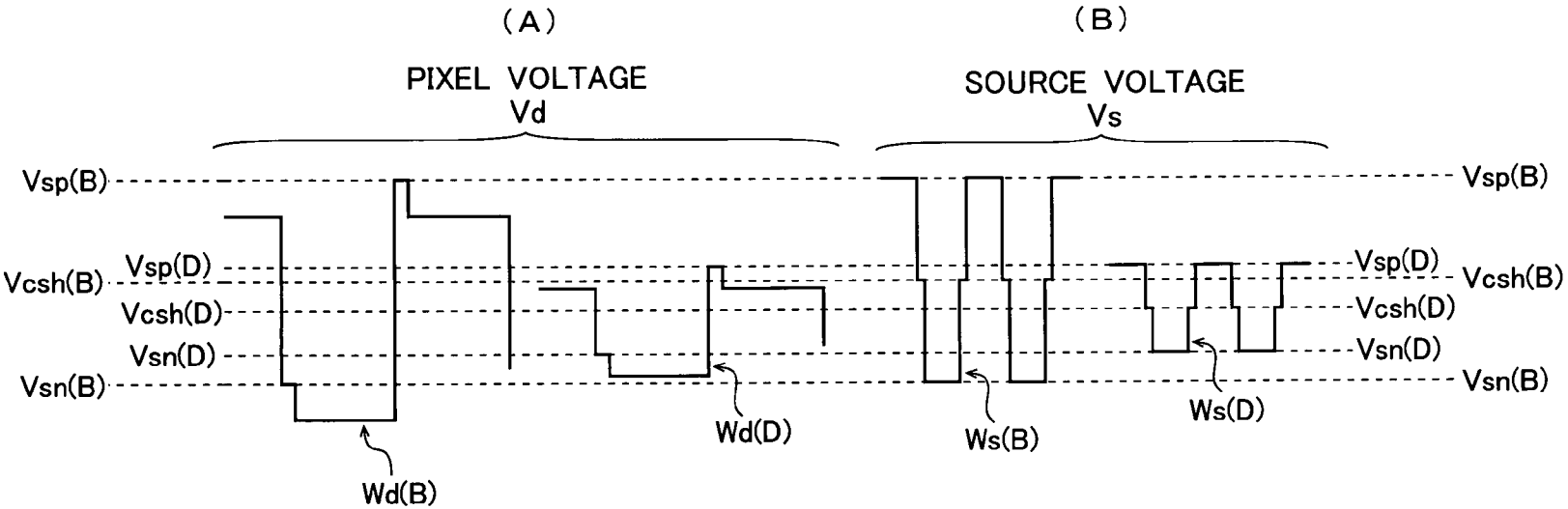
FIGS. 6(A) and 6(B) are voltage waveform diagrams showing a pixel voltage and a source voltage in a case where a source voltage is corrected to compensate for gradation dependence of a pull-in voltage in a liquid crystal display device of a charge sharing scheme.

FIG. 6 shows a voltage waveform Wd(B) for a pixel voltage (hereinafter, referred to as a "high luminance pixel voltage") Vd (B) in a case of displaying a high luminance pixel, a voltage waveform Wd(D) for a pixel voltage (hereinafter, referred to as a "low luminance pixel voltage") Vd(D) in a case of displaying a low luminance pixel, a voltage waveform Ws (B) for a voltage (hereinafter, referred to as a "high luminance source voltage") Vs (B) of a data signal for providing the high luminance pixel voltage Vd (B), and a voltage waveform Ws (D) for a voltage (hereinafter, referred to as a "low luminance source voltage") Vs (D) of a data signal for providing the low luminance pixel voltage Vd(D). Note that the time axis scale is different between the voltage waveform Wd(B) for a high luminance pixel voltage and the voltage waveform Wd(D) for a low luminance pixel voltage, and the voltage waveform Ws(B) for a high luminance source voltage and the voltage waveform Ws(D) for a low luminance source voltage. Note also that in this FIG. 6 "Vsp(B)" represents the maximum value of the high luminance source voltage Vs (B), "Vsn (B)" represents the minimum value of the high luminance source voltage Vs(B), "Vsp(D)" represents the maximum value of the low luminance source voltage Vs(D), and "Vsn (D)" represents the minimum value of the low luminance source voltage Vs (D). "Vcsh (B)" represents the charge sharing voltage in a case where the high luminance source voltage Vs (B) is provided to a source line and "Vcsh (D)" represents the charge sharing voltage in a case where the low luminance source voltage Vs(D) is provided to a source line.

As can be seen from this FIG. 6, because the pull-in voltage ΔVd is different between the high luminance pixel voltage Vd(B) and the low luminance pixel voltage Vd(D) and the above-described amount of correction is different between the high luminance source voltage Vs (B) and the low luminance source voltage Vs(D), the charge sharing voltage Vcsh (B) in a case where the high luminance source voltage Vs(B) is provided to a source line is different from the charge sharing voltage Vcsh (D) in a case where the low luminance source voltage Vs (D) is provided to a source line. That is, the charge sharing voltage Vcsh is different depending on the display gradation.

Figure 3:
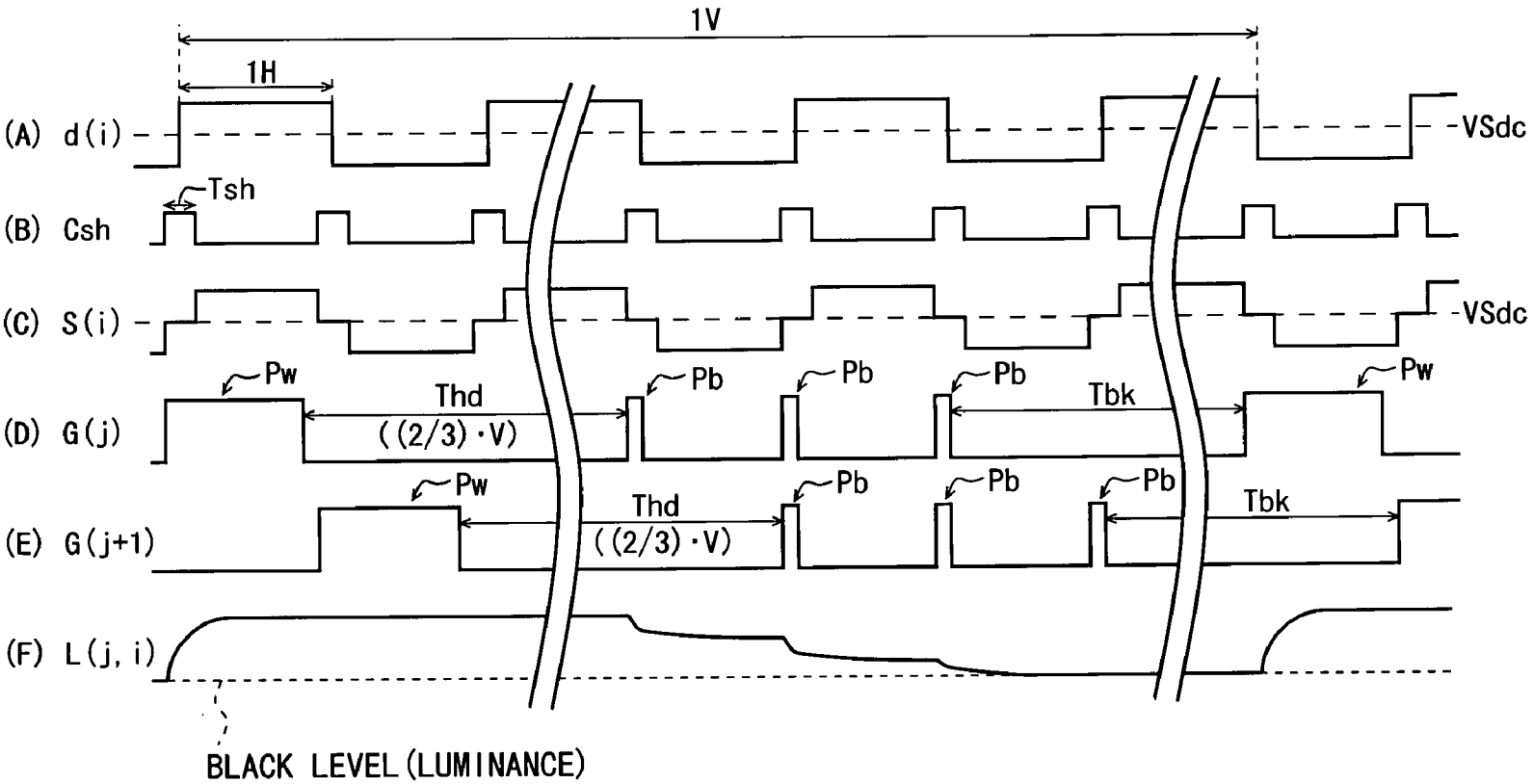
FIGS. 3(A) to 3(F) are signal waveform diagrams for describing the operation of the liquid crystal display device according to the embodiment and basic configuration.
Figure 7:
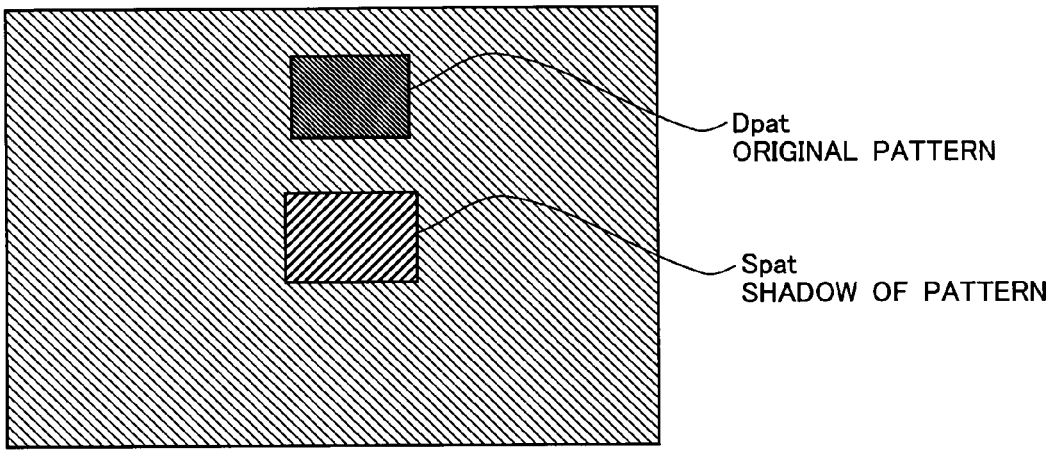
FIG. 7 is a diagram for describing a problem occurring due to black insertion in the liquid crystal display device according to the basic configuration.

In the liquid crystal display device of the above-described basic configuration, as shown in FIG. 3, since a charge sharing voltage (voltage VSdc shown in FIGS. 3(A) and 3(C)) which is a source voltage for a charge sharing period Tsh is a voltage corresponding to black display, black insertion is performed by applying to a gate line GLj a black voltage application pulse Pb which is at an H level during a charge sharing period Tsh (j=1 to m), whereby impulse display is implemented in a pseudo manner. Here, since the pulse width of the black voltage application pulse Pb is short, in order to compensate for an insufficient black voltage write, black insertion is performed for a plurality of charge sharing periods Tsh (three charge sharing periods Tsh in the example shown in FIGS. 3(E) and 3(F)). The charge sharing voltage Vcsh is, even if being a voltage corresponding to black display, different depending on the display gradation because a source voltage is corrected in the manner described above (see FIG. 6(B)). As a result, depending on a display pattern, a shadow of the pattern may be viewed. For example, as shown in FIG. 7, on a screen of a liquid crystal display device, below an original display pattern Dpat a shadow pattern Spat corresponding to the display pattern Dpat may appear based on a write of a charge sharing voltage Vcsh which is a black voltage and this may be viewed as a shadow of the display pattern Dpat.

3. Embodiment

A liquid crystal display device according to an embodiment of the invention which is made to solve the problem of the above-described basic configuration will be described below.

The overall configuration of the liquid crystal display device according to the present embodiment is the same as that of the liquid crystal display device according to the above-described basic configuration and is as shown in FIG. 1 and thus the same or corresponding parts are denoted by the same symbols and detailed description thereof is not repeated. In the present embodiment, an internal configuration of a source driver is different in some points from that of the source driver 300 of the above-described basic configuration, and thus, first the configuration of the source driver will be described.

<3.1 Source Driver>

Figure 8:
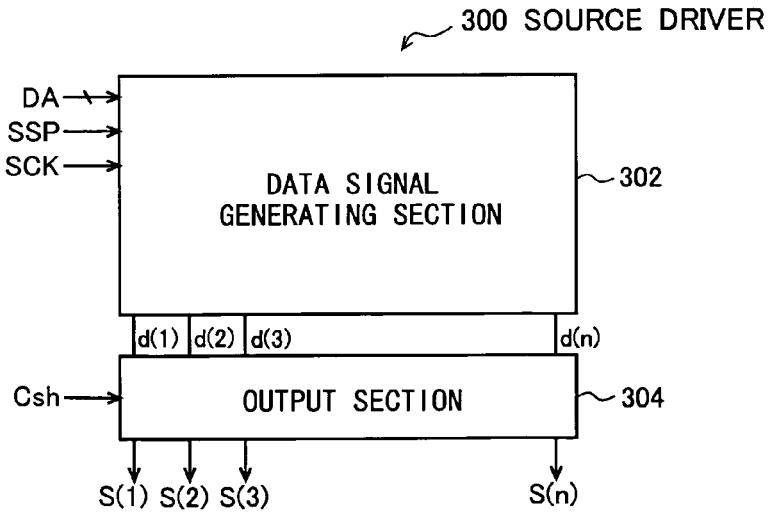
FIG. 8 is a block diagram showing a configuration of a source driver of the liquid crystal display device according to the embodiment.

FIG. 8 is a block diagram showing a configuration of a source driver in the present embodiment. The source driver is composed of a data signal generating section 302 and an output section 304. The data signal generating section 302 generates analog voltage signals d(1) to d(n) for respective source lines SL1 to SLn from a digital image signal DA based on a data start pulse signal SSP and a data clock signal SCK. The configuration of the data signal generating section 302 is the same as that of a conventional source driver (also the same as that of the source driver of the above-described basic configuration) and thus description thereof is omitted. The output section 304 includes an output buffer composed of a voltage follower and provided for each analog voltage signal d(i) to be generated by the data signal generating section 302, and impedance-converts each analog voltage signal d(i) using a corresponding one of the buffers and then outputs the signal d(i) as a data signal S(i) (i=1, 2, . . . , n). Note, however, that as will be described later, based on a charge sharing control signal Csh, during a charge sharing period Tsh, the application of data signals S(1) to S(n) to the source lines SL1 to SLn is cut off and the source lines SL1 to SLn are short-circuited to each other. The output section 304 includes a switching circuit and a power supply for implementing such an operation (the detail will be described later).

Figure 9:
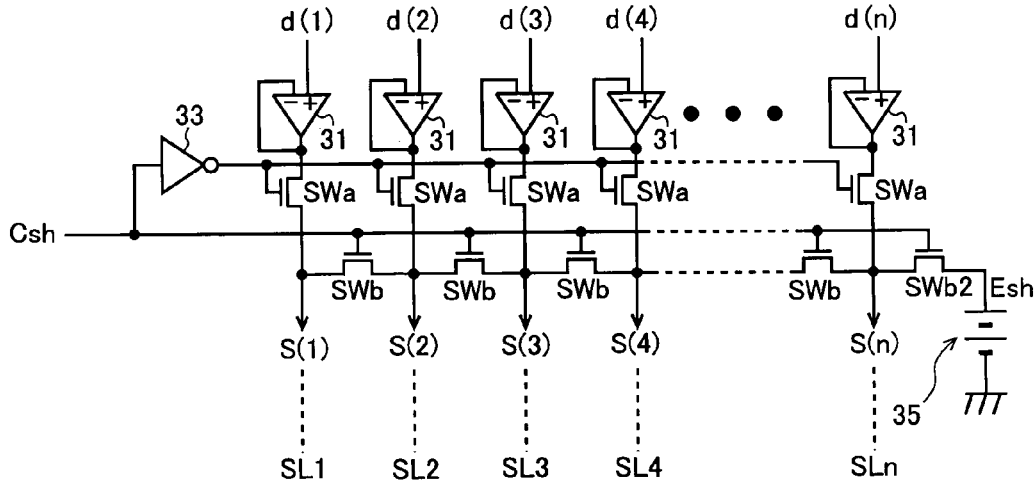
FIG. 9 is a circuit diagram showing a first exemplary configuration of an output section of the source driver in the embodiment.

FIG. 9 is a circuit diagram showing a first exemplary configuration of the output section 304 of the source driver in the present embodiment. The output section 304 of the exemplary configuration includes a switching circuit composed of n first MOS transistors SWa and (n−1) second MOS transistors SWb, which serve as switching elements, and an inverter 33; in terms of this point, the output buffers are the same as those of the source driver 300 of the basic configuration. However, unlike the output section of the source driver 300 of the basic configuration, the output section 304 of the first exemplary configuration includes a charge sharing voltage fixing power supply 35 and the positive side of the charge sharing voltage fixing power supply 35 is connected to an output terminal of the source driver to be connected to any one source line SL(i), through a third MOS transistors SWb2 serving as a switching element (in the example shown in FIG. 9, the positive side is connected to an output terminal to be connected to an nth source line SLn). Then, a charge sharing control signal Csh is inputted to a gate terminal of the third MOS transistor SWb2 and the negative side of the charge sharing voltage fixing power supply 35 is grounded. The charge sharing voltage fixing power supply 35 is a voltage supplying section that provides a fixed voltage Esh corresponding to black display. The voltage Esh should be in a voltage range from the value of a negative polarity data signal S(i) for a gradation of 0 to the value of a positive polarity data signal S(i) for a gradation of 0. Note that although the voltage Esh is applied to a pixel electrode by a black voltage application pulse Pb during a charge sharing period Tsh (see FIG. 3), the voltage (pixel voltage) of the pixel electrode decreases by an amount of a pull-in voltage ΔVd due to the presence of a parasitic capacitance Cgd when the black voltage application pulse falls. Accordingly, since the power supply voltage Esh needs to consider correction of the pull-in voltage ΔVd, even when the power supply voltage Esh is brought to a value close to that of a counter voltage, the pixel voltage does not always go to a voltage corresponding to black display.

Also according to the above-described first exemplary configuration, as in the source driver of the basic configuration, based on a charge sharing control signal Csh, during the period (effective scanning period) other than the charge sharing period Tsh, analog voltage signals d(1) to d(n) generated by the data signal generating section 302 are outputted through the buffers 31 as data signals S(1) to S(n) and the data signals S(1) to S(n) are applied to the source lines SL1 to SLn, and during the charge sharing period Tsh the application of the data signals S(1) to S(n) to the source lines SL1 to SLn is cut off and adjacent source lines are short-circuited to each other (as a result, all source lines SL1 to SLn are short-circuited to each other). In addition, according to the first exemplary configuration, during the charge sharing period Tsh, a voltage Esh of the charge sharing voltage fixing power supply 35 is provided to each source line SLi (i=1 to n) (see FIG. 9). Accordingly, even when the amount of correction of a source voltage is different depending on the display gradation due to compensating for gradation dependence of a pull-in voltage ΔVd, a charge sharing voltage can always be brought to the same voltage Esh during the charge sharing period Tsh which is a black signal insertion period. Accordingly, occurrence of a shadow of a pattern, such as the one shown in FIG. 7, can be suppressed.

However, as can be seen from FIG. 9, in the above-described first exemplary configuration, many of source lines are connected to the charge sharing voltage fixing power supply 35 through a plurality of MOS transistors SWb. Therefore, it takes time for the voltages of all source lines SL1 to SLn to settle to the same charge sharing voltage Esh. As a result, depending on the length of the charge sharing period Tsh, black voltages to be held in pixel capacitances of the respective pixel forming sections upon black insertion cannot be brought to the same voltage and thus the above-described occurrence of a shadow of a pattern may not be able to be sufficiently suppressed.

In view of this, next, an output section of a source driver configured such that during a charge sharing period Tsh all source lines SL1 to SLn go to the same voltage Esh in a short time will be described as a second exemplary configuration.

Figure 10:
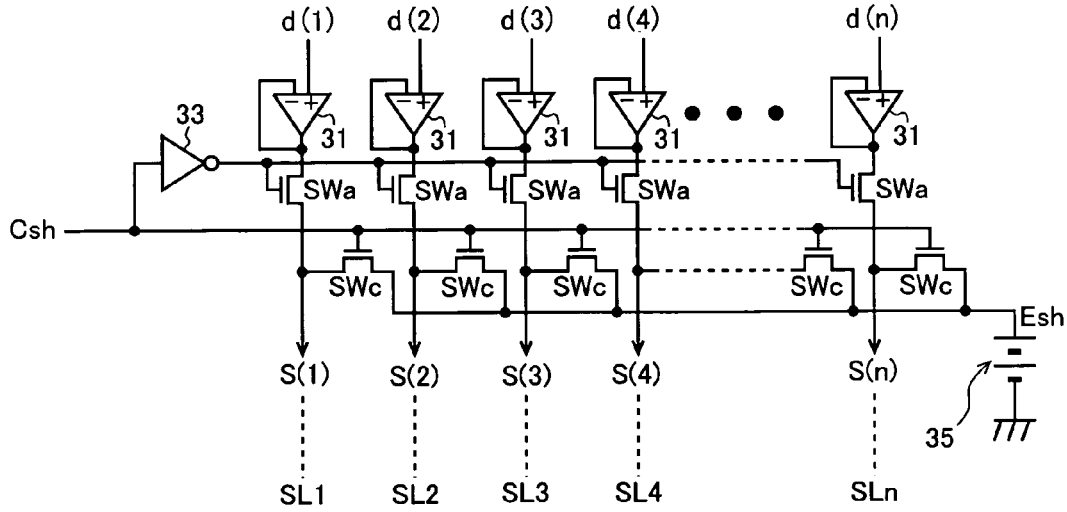
FIG. 10 is a circuit diagram showing a second exemplary configuration of the output section of the source driver in the embodiment.

FIG. 10 is a circuit diagram showing the second exemplary configuration of the output section 304 of the source driver in the present embodiment. Of the components of the output section 304 of this exemplary configuration the same components as those in the first exemplary configuration are denoted by the same symbols and description thereof is not repeated.

Also in the output section 304 of the present exemplary configuration, as in the first exemplary configuration, one second MOS transistor SWc serving as a switching element is provided to each source line SLi (i=1 to n). However, while in the first exemplary configuration a switching circuit is configured such that one second MOS transistor SWb is inserted between adjacent source lines, in the present exemplary configuration a switching circuit is configured such that one second MOS transistor SWc is inserted between each source line SLi and a charge sharing voltage fixing power supply 35. That is, in the present exemplary configuration, an output terminal of the source driver to be connected to a corresponding source line SLi is connected to the positive side of the charge sharing voltage fixing power supply 35 through any one of the second MOS transistors SWc. A charge sharing control signal Csh is provided to all-gate terminals of the second MOS transistors SWc.

Also according to the above-described second exemplary configuration, as in the source driver of the first exemplary configuration or of the basic configuration, based on a charge sharing control signal Csh, during the period (effective scanning period) other than the charge sharing period Tsh, analog voltage signals d(1) to d(n) generated by the data signal generating section 302 are outputted through the buffers 31 as data signals S(1) to S(n) and the data signals S(1) to S(n) are applied to the source lines SL1 to SLn, and during the charge sharing period Tsh the application of the data signals S(1) to S(n) to the source lines SL1 to SLn is cut off and adjacent source lines are short-circuited to each other (as a result, all source lines SL1 to SLn are short-circuited to each other). In addition, according to the second exemplary configuration, during the charge sharing period Tsh, a voltage Esh of the charge sharing voltage fixing power supply 35 is provided to each source line SLi (i=1 to n) (see FIG. 10). Accordingly, even when the amount of correction of a source voltage is different depending on the display gradation due to compensating for gradation dependence of a pull-in voltage ΔVd, a charge sharing voltage can always be brought to the same voltage Esh during the charge sharing period Tsh which is a black signal insertion period. Moreover, during the charge sharing period Tsh, a voltage Esh of the charge sharing voltage fixing power supply 35 is provided to each source line SLi (i=1 to n) through only one MOS transistor SWc. Accordingly, during the charge sharing period Tsh which is a black signal insertion period, the voltage of each source line SLi can be brought to the same voltage Esh in a short time, whereby occurrence of a shadow of a pattern, such as the one shown in FIG. 7, can be surely suppressed.

<3.1 Gate Driver>

Next, the configuration of a gate driver 400 in the present embodiment will be described.

Figure 11:
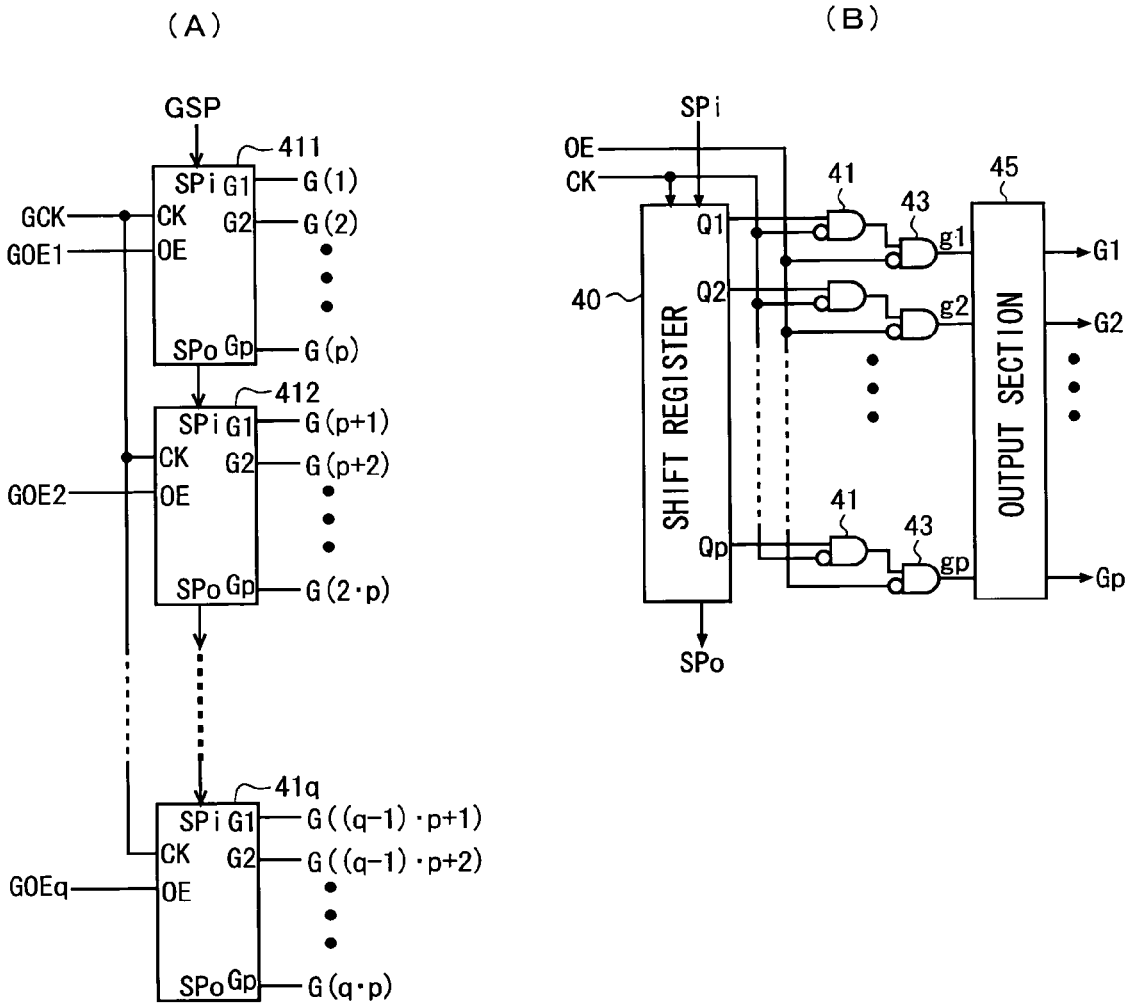
FIGS. 11(A) and 11(B) are block diagrams showing an exemplary configuration of a gate driver in the embodiment.

FIGS. 11(A) and 11(B) are block diagrams showing an exemplary configuration of the gate driver 400 that operates in the manner shown in FIGS. 3(D) and 3(E). The gate driver 400 of the exemplary configuration is composed of a plurality of (q) gate driver IC (Integrated Circuit) chips 411, 412, . . . , 41*q* each including a shift register, which serve as partial circuits.

Each gate driver IC chip includes, as shown in FIG. 11(B), a shift register 40, first and second AND gates 41 and 43 provided for each stage of the shift register 40, and an output section 45 that outputs scanning signals G1 to Gp based on output signals g1 to gp from the second AND gates 43, and receives from an outside source a start pulse signal SPi, a clock signal CK, and an output control signal OE. The start pulse signal SPi is provided to an input terminal of the shift register 40, and from an output terminal of the shift register 40 is outputted a start pulse signal SPo to be inputted to a subsequent gate driver IC chip. To each of the first AND gates 41 is inputted a logically inverted signal of the clock signal CK, and to each of the second AND gates 43 is inputted a logically inverted signal of the output control signal OE. An output signal Qk (k=1 to p) from each stage of the shift register 40 is inputted to a first AND gate 41 provided for the stage and an output signal from the first AND gate 41 is inputted to a second AND gate 43 provided for the stage.

The gate driver 400 of the present exemplary configuration is, as shown in FIG. 11(A), implemented by the plurality of (q) gate driver IC chips 411 to 41*q* of, the above-described configuration being cascade-connected to one another. Specifically, an output terminal (an output terminal for a start pulse signal SPo) of a shift register in each gate driver IC chip is connected to an input terminal (an input terminal for a start pulse signal SPi) of a shift register in a subsequent gate driver IC chip such that the shift registers 40 in the gate driver IC chips 411 to 41*q* form one shift register (the shift registers thus formed by cascade connection are hereinafter referred to as "coupled shift registers"). Note, however, that to an input terminal of a shift register in the first gate driver IC chip 411 a gate start pulse signal GSP is inputted from the display control circuit 200, and an output terminal of a shift register in the last gate driver IC chip 41*q* is not connected to an outside source. Note also that a gate clock signal GCK from the display control circuit 200, is inputted in common to each of the gate driver IC chips 411 to 41*q* as a clock signal CK. On the other hand, a gate driver output control signal GOE generated in the display control circuit 200 is composed of first to qth gate driver output control signals GOE1 to GOEq and the gate driver output control signals GOE1 to GOEq are individually inputted to the gate driver IC chips 411 to 41*q*, respectively, as an output control signal OE.

Figure 12:
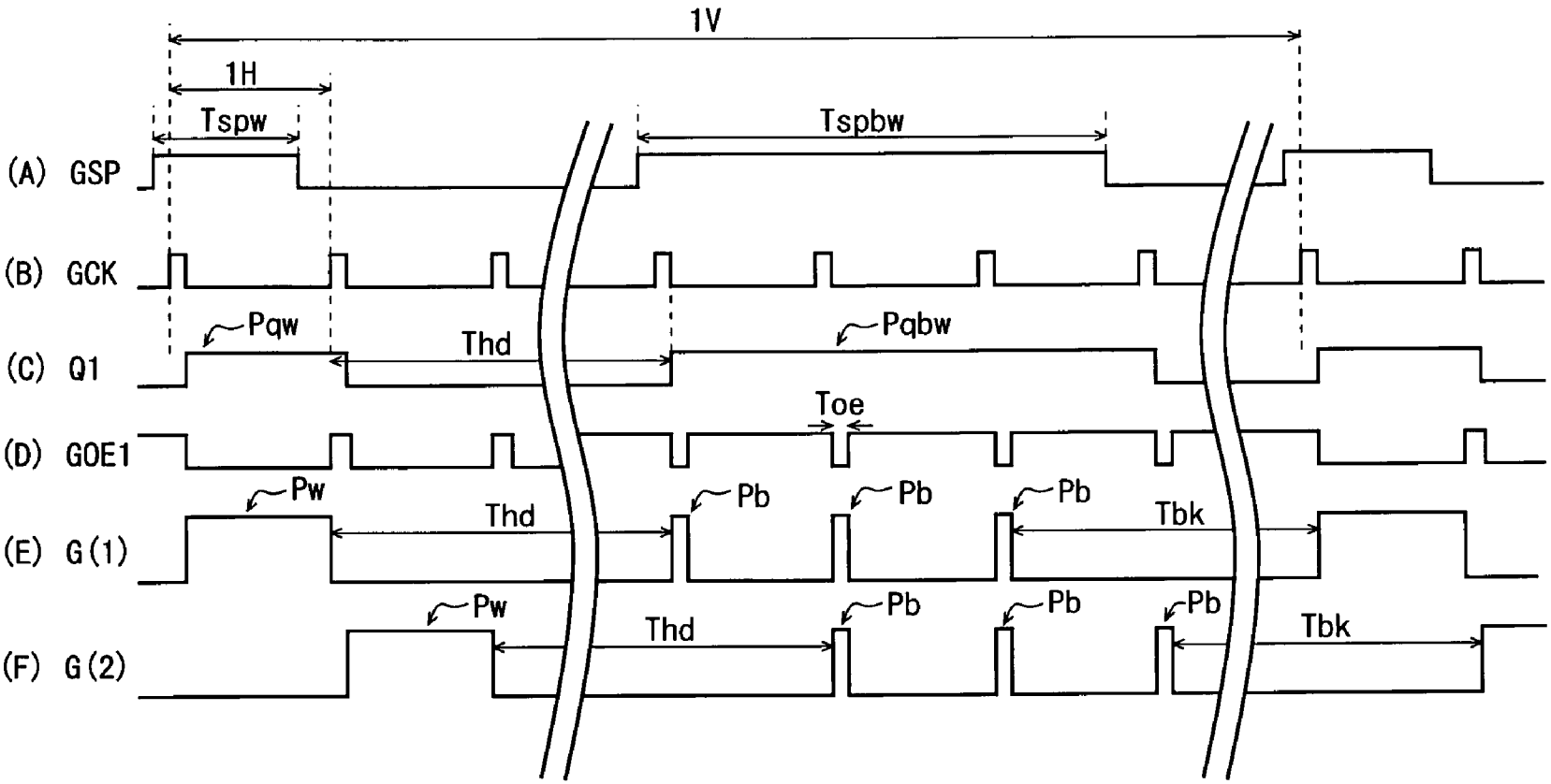
FIGS. 12(A) to 12(F) are signal waveform diagrams for describing the operation of the gate driver of the exemplary configuration.
Figure 13:
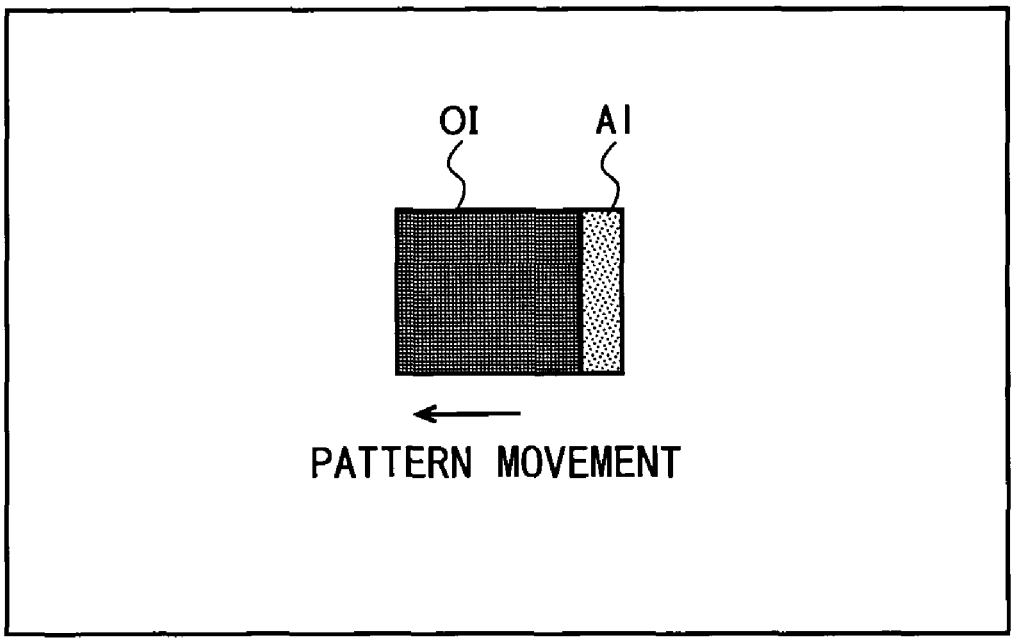
FIG. 13 is a diagram for describing a problem in moving image display in a hold type display device.

Next, with reference to FIG. 12, the operation of the gate driver 400 of the above-described exemplary configuration will be described. The display control circuit 200 generates, as a gate start pulse signal GSP, as shown in FIG. 12(A), a signal that is at an H level (active) during a period Tspw where a pixel data write pulse Pw appears and a period Tspbw where three black voltage application pulses Pb appear and generates, as shown in FIG. 12(B), a gate clock signal GCK which is at an H level during a predetermined period every horizontal scanning period (1H). When such a gate start pulse signal GSP and a gate clock signal GCK are inputted to the gate driver 400 in FIG. 11, a signal such as the one shown in FIG. 12(C) is outputted as an output signal Q1 from the first stage of the shift register 40 in the first gate driver IC chip 411. The output signal Q1 includes, in each frame period, one pulse Pqw corresponding to a pixel data write pulse Pw and one pulse Pqbw corresponding to three black voltage application pulses Pb and the two pulses Pqw and Pqbw are spaced apart by substantially a pixel data holding period Thd. Such two pulses Pqw and Pqbw are sequentially transferred to the coupled shift registers in the gate driver 400, according to the gate clock signal GCK. Accordingly, from each stage of the coupled shift registers a signal having a waveform, such as the one shown in FIG. 12(C), is sequentially outputted so as to be shifted by one horizontal scanning period (1H).

The display control circuit 200 also generates, as described above, gate driver output control signals GOE1 to GOEq to be provided to the gate driver IC chips 411 to 41*q* composing the gate driver 400. Here, a gate driver output control signal GOEr to be provided to an rth gate driver IC chip 41*r* is at an L level during a period where a pulse Pqw corresponding to a pixel data write pulse Pw is outputted from any one of the stages of a shift register 40 in the gate driver IC chip 41*r*, except that the gate driver output control signal GOEr is at an H level for adjustment of the pixel data write pulse Pw during a predetermined period near a pulse of the gate clock signal GCK, and during the other period the gate driver output control signal GOEr is at an H level except that the gate driver output control signal GOEr is at an L level during a predetermined period Toe (the predetermined period Toe is set so as to be included in a charge sharing period Tsh) which is immediately after the gate clock signal GCK is changed to an L level from an H level. For example, a gate driver output control signal GOE1, such as the one shown in FIG. 12(D), is provided to the first gate driver IC chip 411. Note that a pulse that is included in the gate driver output control signals GOE1 to GOEq for adjustment of a pixel data write pulse Pw (which corresponds to that the pulse is at an H level during the above-described predetermined period and which is hereinafter referred to as a "write period adjustment pulse") rises earlier than the rise of the gate clock signal GCK or falls later than the fall of the gate clock signal GCK, according to a necessary pixel data write pulse Pw. Alternatively, without using such a write period adjustment pulse, a pixel data write pulse Pw may be adjusted only by the pulse of the gate clock signal GCK.

In each gate driver IC chip 41*r* (r=1 to q), based on output signals Qk (k=1 to p) from the respective stages of a shift register 40, a gate clock signal GCK, and an gate driver output control signal GOEr, such as those described above, internal scanning signals g1 to gp are generated by first and second AND gates 41 and 43 and the internal scanning signals g1 to gp are level-converted by an output section 45, whereby scanning signals G1 to Gp to be applied to gate lines are outputted. Accordingly, as in the first exemplary configuration, as shown in FIGS. 12(E) and 12(F), a pixel data write pulse Pw is sequentially applied to the gate lines GL1 to GLm, and in each gate line GLj (j=1 to m) a black voltage application pulse Pb is applied at the point in time when a pixel data holding period Thd has elapsed since the pixel data write pulse is applied, and thereafter, two black voltage application pulses Pb are applied at intervals of one horizontal scanning period (1H). After the three black voltage application pulses Pb are thus applied, an L level is maintained until a pixel data write pulse PW for a next frame period is applied. Namely, a black display period Tbk exists during a period from when the above-described three black voltage application pulses Pb have been applied until a next pixel data write pulse Pw is applied.

In the above-described manner, also by the gate driver 400 of the configuration shown in FIGS. 11(A) and 11(B) impulse drive, such as that shown in FIGS. 3(C) to 3(F), can be implemented in the liquid crystal display device.

<3.3 Effects>

As described above, according to the present embodiment, during each charge sharing period Tsh which is when the polarity of data signals S(i) is inverted, the voltage of each source line SLi has a value corresponding to black display (FIG. 3(C)) and to each gate line GLj three black voltage application pulses Pb each are applied during a charge sharing period Tsh at intervals of one horizontal scanning period after the lapse of a pixel data holding period Thd with a length of a 2/3 frame period from the application of a pixel data write pulse Pw (FIGS. 3(D) and 3(E)). Accordingly, a black display period Tbk exists until the next time a pixel data write pulse Pw is applied and thus black insertion of the order of substantially a 1/3 frame period is performed for each frame. That is, black insertion of the same length is performed on all display lines such that a black display period Tbk for implementing impulse drive is shifted by one horizontal scanning period (1H) on each display line (FIGS. 3(D) and 3(E)). Accordingly, without reducing the charging period for a pixel capacitance Cp for writing pixel data, a sufficient black insertion period is reserved, and moreover, the operating speed of the source driver 300 and the like does not need to be increased for black insertion.

In addition, according to the present embodiment, since a voltage Esh of the charge sharing voltage fixing power supply 35 is provided to each source line SLi (i=1 to n) during a charge sharing period Tsh (see FIGS. 9 and 10), even when the amount of correction of a source voltage is different depending on the display gradation due to compensating for gradation dependence of a pull-in voltage ΔVd, a charge sharing voltage can always be brought to the same voltage Esh during the charge sharing period Tsh. Accordingly, occurrence of a shadow of a pattern due to black insertion, such as the one shown in FIG. 7, can be suppressed. Therefore, in a liquid crystal display device of a charge sharing scheme, the performance of moving image display can be improved by performing black insertion without degrading display quality. Note that although. Japanese Unexamined Patent Publication No. 11-85115 (Patent Document 2) and Japanese Unexamined Patent Publication No. 2005-121911 (Patent Document 5) disclose liquid crystal display devices having a means of providing a predetermined potential to each source line (each data signal line) during a period corresponding to the above-described charge sharing period Tsh, they aim to reduce power consumption, increase the speed of precharging, etc., and thus are not intended to fix a charge sharing voltage to prevent degradation of display quality resulting from black insertion, as in the above-described embodiment.

4. Variant

The configuration of the gate driver 400 in the above-described embodiment is not limited to that shown in FIGS. 11(A) and 11(B) and can be any as long as the configuration causes scanning signals G(1) to G(m) such as those shown in FIGS. 3(D) and 3(E) to be generated. Although in the above-described embodiment, as shown in FIGS. 3(D) and 3(E), three black voltage application pulses Pb are applied to each gate line GLj for each frame period, the number of black voltage application pulses Pb for one frame period, i.e., the number of times per frame period that one gate line goes to a selected state during a black signal insertion period, is not limited to three and can be any number greater than or equal to one as long as the number can allow display to have a black level. As can be seen from FIG. 3(F), by changing the number of black voltage application pulses Pb for one frame period, the black level (display luminance) during a black display period Tbk can be set to a desired value.

Although in the above-described embodiment a black voltage application pulse Pb is applied to each gate line GLj at the point in time when a pixel data holding period Thd with a length of a 2/3 frame period has elapsed since a pixel data write pulse Pw is applied (FIGS. 3(D) and 3(E)) and black insertion of the order of substantially a 1/3 frame period is performed for each frame, a black display period Tbk is not limited to a 1/3 frame period. Extending the black display period Tbk increases the effect of implementation of impulse and thus is effective in improving moving image display performance (suppressing a trailing afterimage, etc.) but results in reduction in display luminance, and thus, an appropriate black display period Tbk is to be set taking into account the effect of implementation of impulse and display luminance.

Note that in the above-described embodiment, as shown in FIGS. 9 and 10, by first MOS transistors SWa, second MOS transistors SWb and a third MOS transistor SWb2, or second MOS transistors SWc, and an inverter 33, a switching circuit is composed that cuts off the application of data signals S(1) to S(n) to source lines SL1 to SLn and short-circuits the source lines SL1 to SLn (respective adjacent source lines) to each other during a charge sharing period Tsh and the switching circuit is included in the source driver 300. However, the configuration may be such that part or all of the switching circuit is provided external to the source driver 300, e.g., the switching circuit is integrally provided with a pixel array in the display section 100 using TFTs.

INDUSTRIAL APPLICABILITY

The present invention can be applied to an active matrix type liquid crystal display device using switching elements such as thin film transistors.

The invention claimed is:

1. An active matrix type liquid crystal display device comprising:

a plurality of data signal lines;

a plurality of scanning signal lines intersecting the plurality of data signal lines;

a plurality of pixel forming sections arranged in a matrix form correspondingly to respective intersections of the plurality of data signal lines and the plurality of scanning signal lines, each pixel forming section capturing, as a pixel value, a voltage of a data signal line passing through a corresponding intersection when a scanning signal line passing through the corresponding intersection is selected;

a data signal line drive circuit configured to apply a plurality of data signals representing an image to be displayed, to the plurality of data signal lines, respectively, and configured to generate the plurality of data signals such that data signals to be respectively applied to adjacent data signal lines have different polarities and polarity of the plurality of data signals is inverted every predetermined cycle in each frame period;

a switching circuit, provided inside or external to the data signal line drive circuit, configured to cut off the application of the plurality of data signals to the plurality of data signal lines and configured to short-circuit the plurality of data signal lines to each other, when the polarity of the plurality of data signal is inverted;

a voltage supplying section configured to apply a fixed voltage corresponding to black display to the plurality of data signal lines during a predetermined black signal insertion period when the plurality of data signal lines are short-circuited to each other by the switching circuit; and a scanning signal line drive circuit configured to selectively drive the plurality of scanning signal lines such that each of the plurality of scanning signal lines goes to a selected state at least once during an effective scanning period in each frame period and a scanning signal line brought to a selected state during the effective scanning period goes to a selected state at least once during the black signal insertion period within a period from when a pixel value holding period has elapsed since the scanning signal line is changed from the selected state to a non-selected state until the scanning signal line goes to a selected state during an effective scanning period in a next frame period, the effective scanning period being a period other than the black signal insertion period, wherein the liquid crystal display device is configured to operate in a normally black mode.

2. The liquid crystal display device according to claim 1, wherein the data signal line drive circuit includes output buffers configured to output data signals to be applied to the respective data signal lines, and the switching circuit includes:

a first switching element provided between each data signal line and a corresponding one of the output buffers and going to a cut-off state during the black signal insertion period;

a second switching element provided between adjacent data signal lines and going to a conducting state during the black signal insertion period; and a third switching element provided between any one of the plurality of data signal lines and the voltage supplying section and going to a conducting state during the black signal insertion period.

3. The liquid crystal display device according to claim 1, wherein the data signal line drive circuit includes output buffers configured to output data signals to be applied to the respective data signal lines, and the switching circuit includes:

a first switching element provided between each data signal line and a corresponding one of the output buffers and going to a cut-off state during the black signal insertion period; and a second switching element provided between each data signal line and the voltage supplying section and going to a conducting state during the black signal insertion period.

4. The liquid crystal display device according to claim 1, wherein the scanning signal line drive circuit causes a scanning signal line brought to a selected state during the effective scanning period to go to a selected state a plurality of times during the black signal insertion periods within a period from when the pixel value holding period has elapsed since the scanning signal line is changed from the selected state to a non-selected state until the scanning signal line goes to a selected state during an effective scanning period in a next frame period.

5. A drive method for an active matrix type liquid crystal display device including a plurality of data signal lines; a plurality of scanning signal lines intersecting the plurality of data signal lines; and a plurality of pixel forming sections arranged in a matrix form correspondingly to respective intersections of the plurality of data signal lines and the plurality of scanning signal lines, each pixel forming section capturing, as a pixel value, a voltage of a data signal line passing through a corresponding intersection when a scanning signal line passing through the corresponding intersection is selected, the drive method comprising:

applying a plurality of data signals representing an image to be displayed, to the plurality of data signal lines, respectively, and generating the plurality of data signals such that data signals to be respectively applied to adjacent data signal lines have different polarities and polarity of the plurality of data signals is inverted every cycle in each frame period;

cutting off the application of the plurality of data signals to the plurality of data signal lines and short-circuiting the plurality of data signal lines to each other, when the polarity of the plurality of data signal is inverted;

providing a fixed voltage corresponding to black display to the plurality of data signal lines during a black signal insertion period when the plurality of data signal lines are short-circuited to each other; and selectively driving the plurality of scanning signal lines such that each of the plurality of scanning signal lines goes to a selected state at least once during an effective scanning period in each frame period and a scanning signal line brought to a selected state during the effective scanning period goes to a selected state at least once during the black signal insertion period within a period from when a pixel value holding period has elapsed since the scanning signal line is changed from the selected state to a non-selected state until the scanning signal line goes to a selected state during an effective scanning period in a next frame period, the effective scanning period being a period other than the black signal insertion period, wherein the liquid crystal display device is configured to operate in a normally black mode.

* * * * *